US006231402B1

(12) United States Patent
Kikuchi

(10) Patent No.: US 6,231,402 B1
(45) Date of Patent: May 15, 2001

(54) PRESS-IN CONTACT AND MANUFACTURING METHOD THEREOF

(75) Inventor: Kazuya Kikuchi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/290,258

(22) Filed: Apr. 13, 1999

(30) Foreign Application Priority Data

Apr. 14, 1998 (JP) ..... 10-120076

(51) Int. Cl.[7] ..... H01R 13/42; H05K 1/00
(52) U.S. Cl. ..... 439/751; 439/82
(58) Field of Search ..... 439/751, 82, 873, 439/825, 826, 827, 603, 744–749

(56) References Cited

U.S. PATENT DOCUMENTS 4,936,797 * 6/1990 Wehrle et al. ..... 439/751

FOREIGN PATENT DOCUMENTS 59-98482 6/1984 (JP) .
60-59676 4/1985 (JP) .
60-189879 9/1985 (JP) .
60-230371 11/1985 (JP) .
62-144072 9/1987 (JP) .
63-54273 4/1988 (JP) .
2-1870 1/1990 (JP) .

* cited by examiner

*Primary Examiner*—Brian Sircus
*Assistant Examiner*—Chandrika Prasad
(74) *Attorney, Agent, or Firm*—Young & Thompson

(57) ABSTRACT

A press-in contact and manufacturing method thereof, which is forced into a through-hole covered with metallic film on the inside of a hole of a printed board, for connecting to the through-hole electrically and mechanically. A press fitting section of the press-in contact can be manufactured easily. The press-in contact always exercises stable electrical and mechanical characteristic in relation to wide variation of inner diameter of the through-hole. The press-in contact includes one side being connected to a base section through respective connecting sections; and another side provided with at least a first and second contact wing sections. The base section and the first and the second contact wing sections are connected to the through-hole electrically and mechanically at the time of press fitting to the through-hole, and the first and second contact wing sections are connected to the connecting section. An internal edge section of the connecting section intervening between the first contact wing section and the second contact wing section is approximately straight shape.

13 Claims, 13 Drawing Sheets

PRESS-IN CONTACT AND MANUFACTURING METHOD THEREOF

BACKGROUND OF THE INVENTION

The present invention relates to a structure of a press-in contact and a manufacturing method thereof. More particularly, this invention relates to a structure of a press fitting section of a press-in contact and manufacturing method thereof. The press-in contact is used to implement mechanical fixing and solderless electrical connecting by forcing a contact pin used as a connector into through-hole of a printed board.

DESCRIPTION OF THE PRIOR ART

The conventional structure and manufacturing method of a press-in contact will be described by referring to the drawings. FIGS. 1 to 8 are views showing a structure and a manufacturing method of the conventional press-in contact. FIGS. 1 to 4 show a first conventional example, and FIGS. 5 to 8 show a second conventional example.

FIG. 1 is a perspective view for explaining the first conventional example. FIG. 2A is a plan view observing FIG. 1 from above, and FIG. 2B is a cross sectional view of a through-hole section of a substrate into which the press-in contact is inserted. FIG. 3 is an elevation view showing a press fitting cross section of line III—III of FIG. 2A. FIG. 4 is a view showing a cross section of a press fitting section after insertion of the press-in contact into the through-hole.

Referring to FIGS. 1 to 4, the press-in contact comprises a concave shaped groove 51 formed in the direction of insertion (length direction), a press fitting section 52 having two concave sections 71, 72 provided at an opposite face of the concave shaped groove 51, a post section 54 which is at the pointed end of the press-in contact, and a transition section 53 which connects the press fitting section 52 to the post section 54.

The press-in contact constituted above is inserted into the through-hole 62 of the printed board 61. At this time, a beam (73, 74, 75 of FIG. 3 or 76, 77, 78 of FIG. 3) which is formed at both sides of the press fitting section 52 of the press-in contact is deformed, thus contacting internally with metallic film 63 formed on the inside of the through-hole 62. That is to say, it assumes the shape of compliant press-in.

Next, deformation of the press fitting section 52 before and after forcing the press-in contact into the through-hole 62 will be described.

As shown in FIG. 3, an internal edge section of the press fitting section 52, before forcing it into the through-hole 62, is formed by the concave U-shaped groove 51. Further, an external edge section comprises an arm section 75 provided with contact sections 73, 74 for contacting with the metallic film 63 of the through-hole 62, an arm section 76 having a symmetrical shape about the center line of the concave shaped groove 51, is provided with contact sections 77, 78, solid sections 80 having convex shaped circular arc 79 at the external section for contacting with the metallic film 63, and connecting sections 55, 56 for connecting the solid section 80 to respective arm sections 75, 76.

As shown in FIG. 4, the press fitting section 52 is forced into the through-hole 62. A total of five contact points—73, 74, 77, 78, and 79—make contact with the metallic film 63. The arm sections 75, 76 are deformed toward the inside direction of the concave shaped groove 51, with the connecting sections 55, 56 as the center of rotation, and are thus electrically connected to the metallic film 63.

A characteristic of the first conventional example, when the press fitting section 52 is forced into the through-hole 62 whose diameter is different, there are total of five contact points, such as contact sections 73, 74, 77, 78, and circular arc 79 contacting with the through-hole, and deformation of the arm sections 75, 76 occurs mainly during rotation of 75, 76 toward the concave shaped groove 51, with the connecting sections 55, 56 acting as the center of rotation. The configuration of the conventional example is disclosed in Japanese Utility Model Laid-Open No. HEI 2-1870.

A second conventional example is now described by referring to the drawings. FIG. 5 is a perspective view for explaining the second conventional example. FIG. 6A is a plan view observing FIG. 5 from above. FIG. 6B is a cross sectional view of through-hole section of a board into which press-in contact is inserted. FIG. 7 is an elevation view showing a press fitting cross section of VII-VII' line of FIG. 6A. FIG. 8 is a view showing a cross section of a press fitting section after insertion of the press-in contact into the through-hole.

Referring to FIGS. 5 to 8, the press-in contact comprises a press fitting section 82 having concave shaped groove 81 formed in the direction of insertion (length direction), a post section 84 which is the pointed end of the press-in contact, and a transition section 83 which connects the press fitting section 82 to the post section 84.

The press-in contact constituted above, when forced into the through-hole of the printed board 91, contacts internally with the metallic film 93 which forms an internal face of the through-hole 92, and assumes the shape of a compliant press-in.

The state of deformation of the press fitting section 82 before and after press fitting, at the time of being forced into the through-hole 92, will now be described by referring to FIGS. 7, 8.

As shown in FIG. 7, an internal edge section of the press fitting section 82, before being forced into the through-hole 92, is formed by a concave, U-shaped groove 81 having a circular arc 101 at the base section. Further, an external edge section comprises arm sections 105, 106 having two pieces of circular arcs 103, 104 for contacting the metallic film 93 of the through-hole 92, and a straight line section 107 connecting the circular arcs 103, 104.

The center of the circular arc 101 of the internal edge section is off-center with respect to the circular arcs 103, 104 of the external edge section. Both circular arcs have the relationship of an eccentric circle. Thickness of the arm sections 105, 106 becomes thinner as they are rotated toward the open side of the U-shape.

As shown in FIG. 8, the press fitting section 82 is forced into the through-hole 92. The respective two circular arcs 103, 104 are in contact with the metallic film 93. The arm sections 105, 106 are deformed in the direction of the concave shaped groove 81, and are thus connected to the metallic film 93 electrically and mechanically.

A characteristic of the second conventional example is that when the press fitting section 82 is forced into the through-hole 92 having a different diameter, contact points with the through-hole consist of pieces of circular arcs 103, 104 as a whole. The configuration of the conventional example is disclosed in Japanese Patent Application Laid-Open No. HEI 8-31476.

A manufacturing method for a press-in contact according to the first and the second conventional examples described-above will now be discussed.

Generally, the press-in contact is subjected to stamping by a progressive press. Representative manufacturing processes of a progressive type consist of the following four processes: (a) a process for stamping material of press-in contact in the board thickness direction, thus for implementing shape blanking of the post section, the transition section, and the press fitting section, (b) a process for forming an internal edge section and a contact section by a protruded punch, (c) a process for forming, in sequence, an internal edge section, a contact wing section, a connection section, and the base section by a die for forming a protrusion of the base section and the connecting section at an opposite side of a protruded punch, and (d) a process for forming the contact wing section, connection section, and protrusion by smooth circular arc using a face press punch.

In the conventional press-in contact described-above, when there is a difference between an external diameter of the press fitting section and an inner diameter of the through-hole of 0.2 mm, contact force between the press-in contact and the through-hole fluctuates largely, so that there is a problem that holding power cannot be surely stabilized.

The reason for this problem in the first conventional example is described using FIGS. 3 and 4. Contact between the press-in contact and the through-hole 62 consists of total five points of contact, sections 73, 74, 77, 78 and the circular arc 79. The press-in contact is forced into the through-hole 62. The contact sections 73, 74, 77, 78 are deformed while revolving with fulcrums 57, 58 of connecting sections 55, 56 as a center.

In the deformation process, the fulcrums 57, 58 are A adjacent to a position of the center line of the through-hole 62. Diagonal dimensions of the press-in contact are scarcely changed, because there is no difference in the distance between the fulcrums 57, 58 and respective high and low contact sections of the contact wing sections (interval between 57 and 74, interval between 57 and 73 of FIG. 4).

Consequently, when the press-in contact is forced into the through-hole having a different inner diameter, the press-in contact cannot flexibly cope with variation of the inner diameter, thus large differences in the holding power occur.

Namely, when the diagonal dimensions of the press-in contact are almost the same as that of the inner diameter of the through-hole 62, the holding power is weak. When the inner diameter of the through-hole 62 becomes small, the holding power increases. As the inner diameter of the through-hole 62 becomes still smaller, buckling occurs at the connecting sections 55, 56, and thus the holding power deteriorates suddenly.

The second conventional example is described using FIGS. 7, 8. The contact section between the press-in contact and the through-hole 92 is the circular arcs 103, 104 as a whole. The press-in contact is forced into the through-hole 92. Force is added only in the neighborhood of open end sections 108, 109 whose thickness is relatively thin among the arm sections 105, 106, and thus the open end sections 108, 109 collapses toward the inside of the concave shaped groove which is then deformed.

Root sections 110, 111 of the circular arcs 103, 104, which are in the contact range, are positioned at the lower side of the maximum depth section 112 of the concave shaped groove 81, and the thickness thereof is thick so that root sections 110, 111 are scarcely deformed even though force is added centripetally from the through-hole 92 in the deformation process.

When the press-in contact is forced into the through-hole having a small inner diameter, force added to the contact point between the solid section and the through-hole becomes particularly large, with the result that the metallic film within the through-hole is damaged, and thus the reliability of electrical and mechanical connection largely deteriorates.

The press-in contact shown in the first conventional example described-above has the problem that when the press fitting section is formed to implement collapse, the die is damaged because the shape is complicated.

In the first conventional example, there are three large concave shaped grooves in the press-in contact. Three convex protrusions for the die for forming the concave shaped groove must be provided. The respective positions of the three convex protrusions become unbalanced, and thus strongly receive the stress from the lateral direction in the course of processing, with the result that the convex protrusion is often damaged.

Furthermore, the press-in contact shown in the second conventional example described above cannot be manufactured by a simple progressive die, because the press-in contact has a deep concave shaped groove and large circular arc section, and thus the processing time is large.

Consequently, it is necessary to implement at least four processes which are incapable of guaranteeing characteristics of the press-in contact, unless the precision of processing is improved, and there also is the problem that the die is incapable of being simply manufactured.

SUMMARY OF THE INVENTION

In view of the foregoing, it is an object of the present invention, in order to overcome the above mentioned problems, to provide a press-in contact and a manufacturing method thereof, which is forced into a through-hole covered with metallic film on the inside of a hole of a printed board, for connecting to the through-hole electrically and mechanically. A press fitting section of the press-in contact can be manufactured easily. The press-in contact always exhibits stable electrical and mechanical characteristics in relation to a wide variation in the inner diameter of the through-hole.

According to a first aspect of the present invention, in order to achieve the above mentioned object, a press-in contact is provided, having a cross sectional shape of a face perpendicular to the press fitting direction, which comprises one side being connected to a base section through respective connecting sections, and another side provided with at least a first and second contact wing sections which are expanded, wherein the base section and the first and the second contact wing sections are connected to the through-hole electrically and mechanically at the time of press fitting to the through-hole, and the first and the second contact wing sections are connected to the connecting section with an isolated condition at the one side, and an internal edge section of the connecting section intervening between the first contact wing section and the second contact wing section is approximately straight.

According to a second aspect of the present invention, there is provided a press-in contact, wherein the length of a straight line of the internal edge section is adjusted while being fitted into the inner diameter of the through-hole.

According to a third aspect of the present invention, there is provided a press-in contact, wherein when the inner diameter of the through-hole is relatively large, and wherein the press fitting section, in a cross section perpendicular to the press fitting direction, is contacted with an internal wall of the through-hole at a total of three points of the first and the second contact wing sections and the base section, and when the inner diameter of the through-hole is relatively small, the press fitting section is contacted with an internal wall of the through-hole at a total of five points, two points in each of the first and the second contact wing sections, respectively, and the base section.

According to a fourth aspect of the present invention, there is provided a press-in contact, wherein, in the cross sectional shape of the press fitting section, when the distance between both peripheral sides of the contact wing section is taken to be "W", the distance between the bottom of the base section and an end section of the open side of the contact wing section is taken to be "H", and the distance between an external edge of the connecting section and an end section of the open side of the contact wing section is taken to be "L", they satisfy a required condition established beforehand.

According to a fifth aspect of the present invention, there is provided a press-in contact wherein the required condition has a relationship wherein $W^2+4\times H\times L$, is approximately equal to $4\times H^2$.

According to a sixth aspect of the present invention, there is provided a press-in contact, having a cross sectional shape of a face perpendicular to the press fitting direction, which comprises one side being connected to a base section through respective connecting sections, and another side provided with at least a first and second contact wing sections which are expanded, wherein the base section and the first and the second contact wing sections are connected to the through-hole electrically and mechanically at the time of press fitting to the through-hole, and while being in the condition of being forced into the through-hole, a fulcrum of deformation of the contact wing sections is isolated from the through-hole center by a required distance.

According to a seventh aspect of the present invention, there is provided a press-in contact, wherein the required distance is approximately one-fourth the inner diameter of the through-hole.

According to an eighth aspect of the present invention, there is provided a press-in contact, wherein, in the cross sectional shape of the press fitting section, a distance between a fulcrum of deformation of the contact wing section and an end section of the open side of the contact wing section differs from the distance between the fulcrum of deformation of the contact wing section and the end section of the connecting section.

According to a ninth aspect of the present invention, there is provided a manufacturing method of a press-in contact which is forced into a through-hole disposed within a printed board, and which consists of a post section, a transition section, and a press fitting section, wherein the press fitting section which is held mechanically and electrically in the through-hole and includes, in the cross sectional shape thereof, a base section which is not deformed at the time of press fitting, a contact wing section which is deformed so as to be contacted internally with said through-hole, and a connecting section intervening between the base section and the contact wing section, which comprises the processes of (a) stamping material of press-in contact in the board thickness direction, thus implementing shape blanking of the post section, the transition section, and the press fitting section, (b) simultaneously forming a concave shaped groove, the contact wing section, a connecting section and a protruded section of the base section by an inverse trapezoid shaped punch for forming the concave shaped groove including a straight line section at a bottom section of the press fitting section, and a die for forming the protruded section which becomes the base section, contact wing sections disposed at both sides of the concave shaped groove, and the connecting section connecting the base section at an opposite side of said inverse trapezoid shaped punch, and (c) forming the contact wing section, the connecting section and the protruded section by a face press punch with a smooth circular arc.

The above and further objects and novel features of the invention will be more fully understood from the following detailed description when read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

In a desirable configuration of a press-in contact according to the present invention having a cross sectional shape perpendicular to the press fitting direction, one side is connected to a base section (24 of FIG. 12A) through a connecting section (25, 26 of FIG. 12A) respectively. The other side is provided with two expanded contact wing sections (22, 23 of FIG. 12A), and an internal edge section of the connecting section, which is positioned in between the two contact wing sections, and which has a straight line section.

A preferred embodiment of the present invention will be described in detail in accordance with the accompanying drawings.

Figure 9:
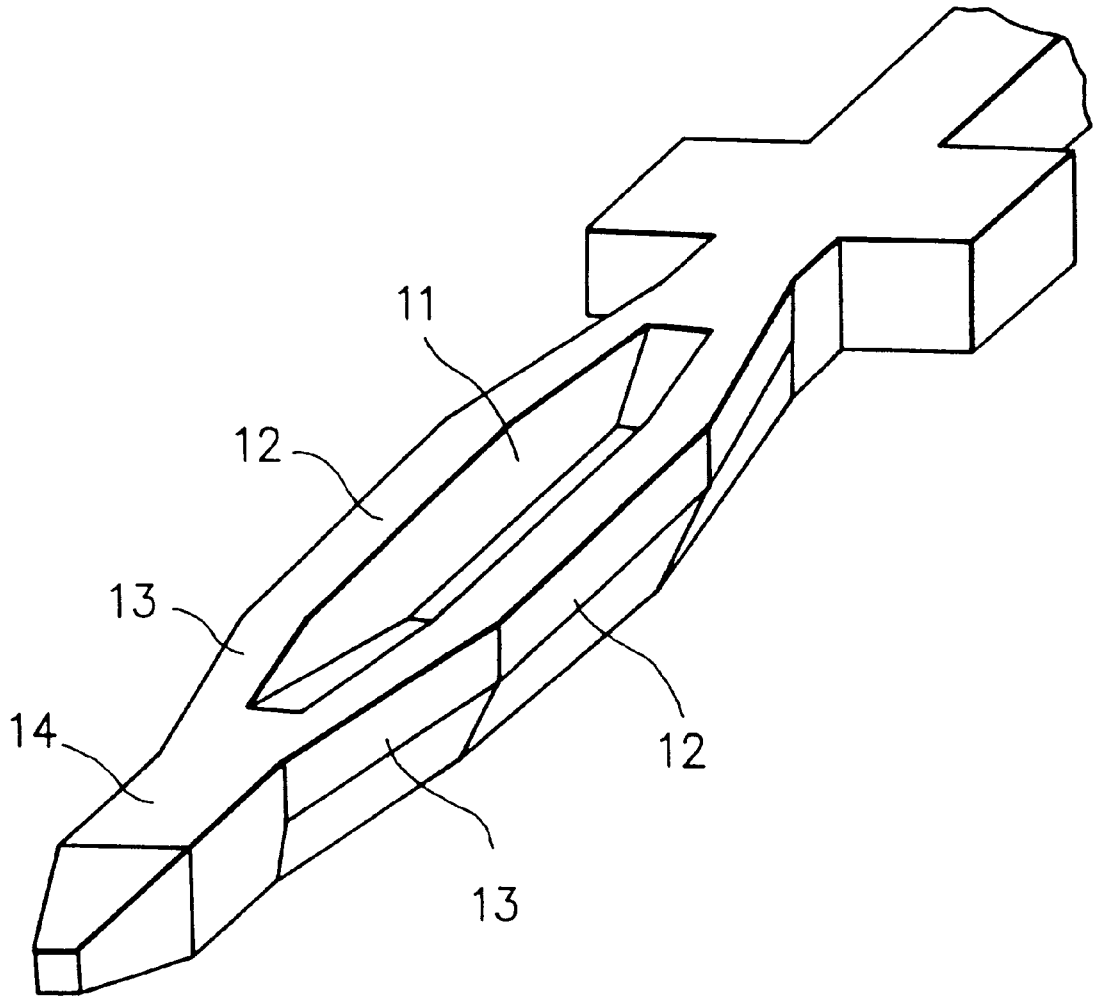
FIG. 9 is a perspective view for explaining structure of the press-in contact according to an embodiment of the present invention.
Figure 10A:
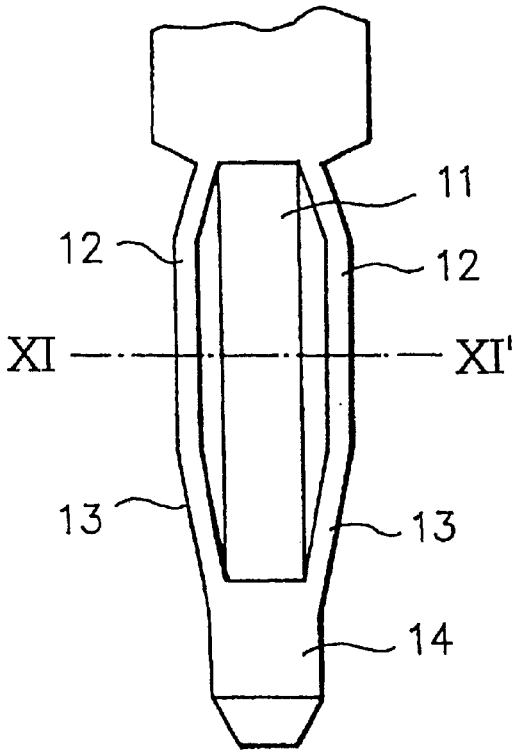
FIG. 10A is a plan view of FIG. 9 for explaining structure of the press-in contact according to an embodiment of the present invention.
Figure 10B:
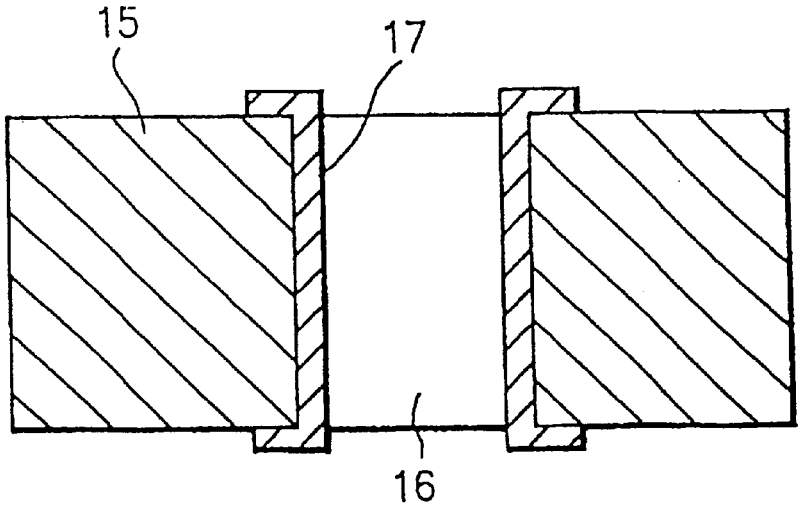
FIG. 10B is a cross sectional view of the through-hole section of the board for explaining structure of the press-in contact according to an embodiment of the present invention.
Figure 11:
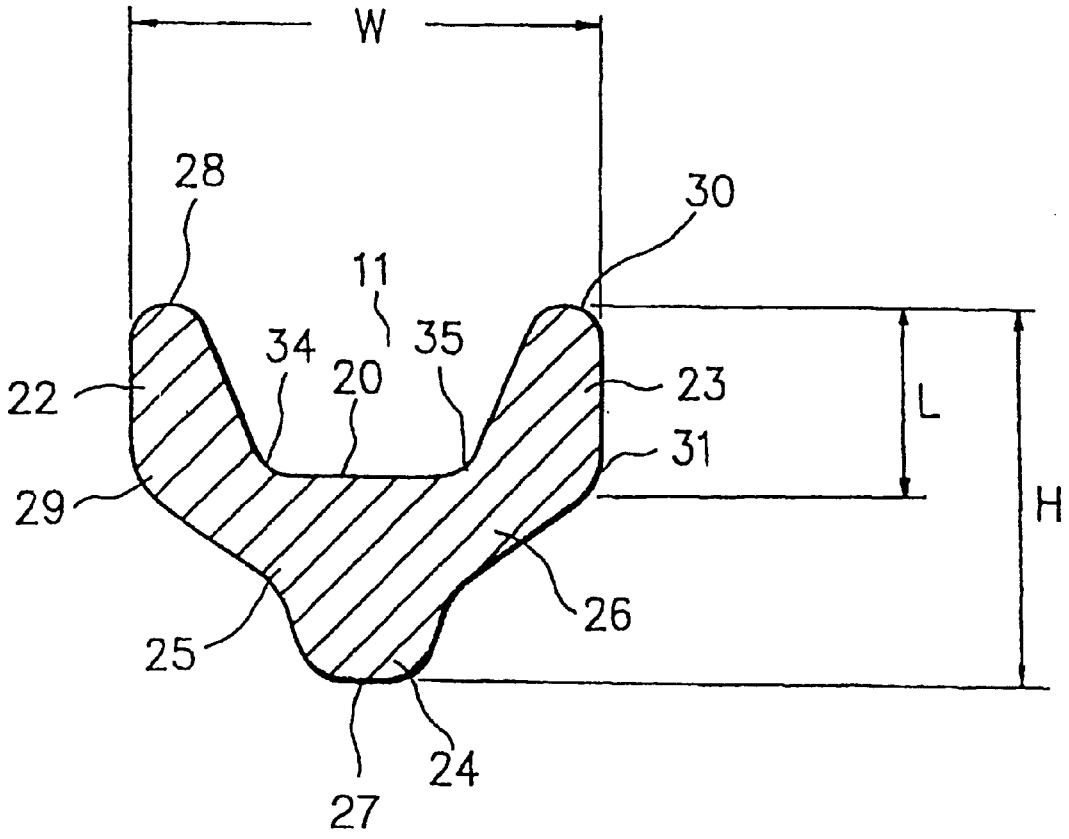
FIG. 11 is a cross sectional view along line XI-XI' of FIG. 10A for explaining structure of the press fitting section of the press-in contact according to an embodiment of the present invention.
Figure 12A:
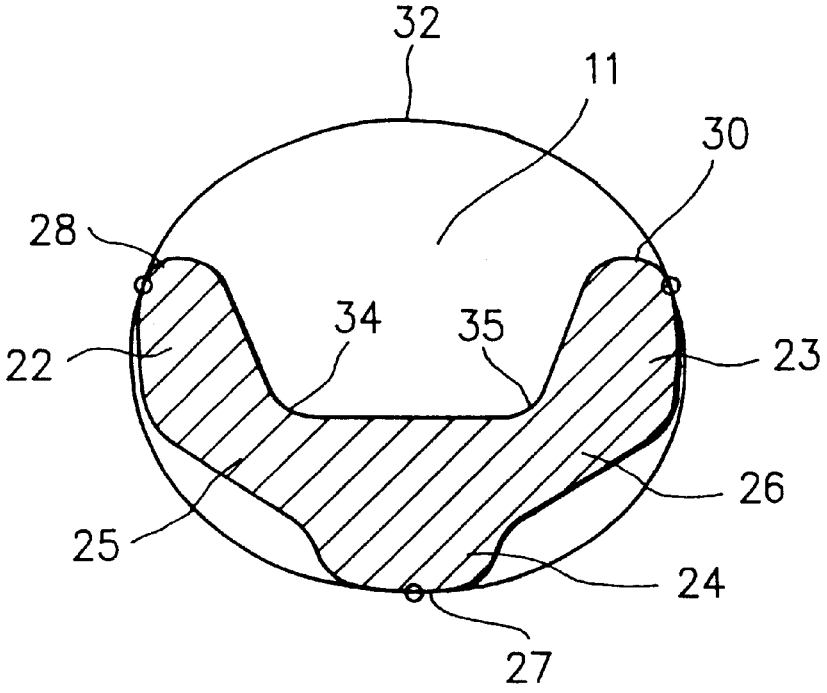
FIG. 12A is a cross sectional view showing a state where the press-in contact is forced into a through-hole with a relatively large inner diameter according to the embodiment of the present invention.
Figure 12B:
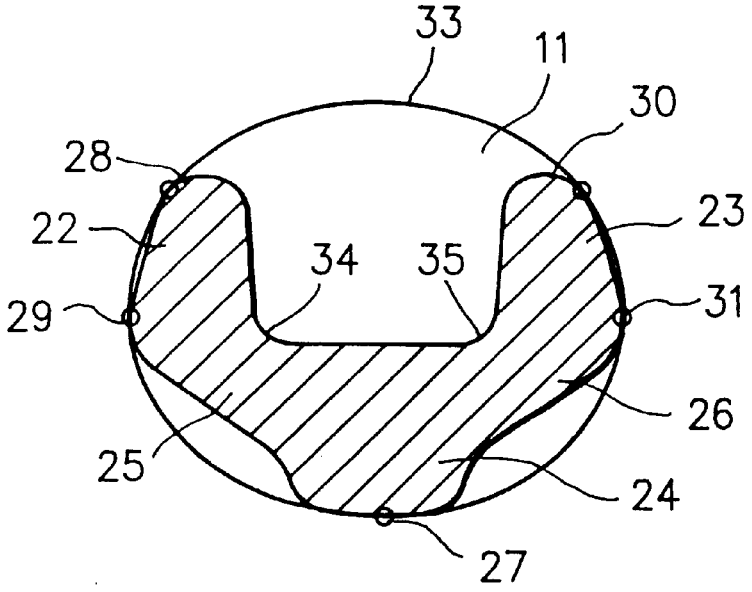
FIG. 12B is a cross sectional view showing a state where the press-in contact is forced into the through-hole with a relatively small inner diameter according to the embodiment of the present invention.
Figure 13:
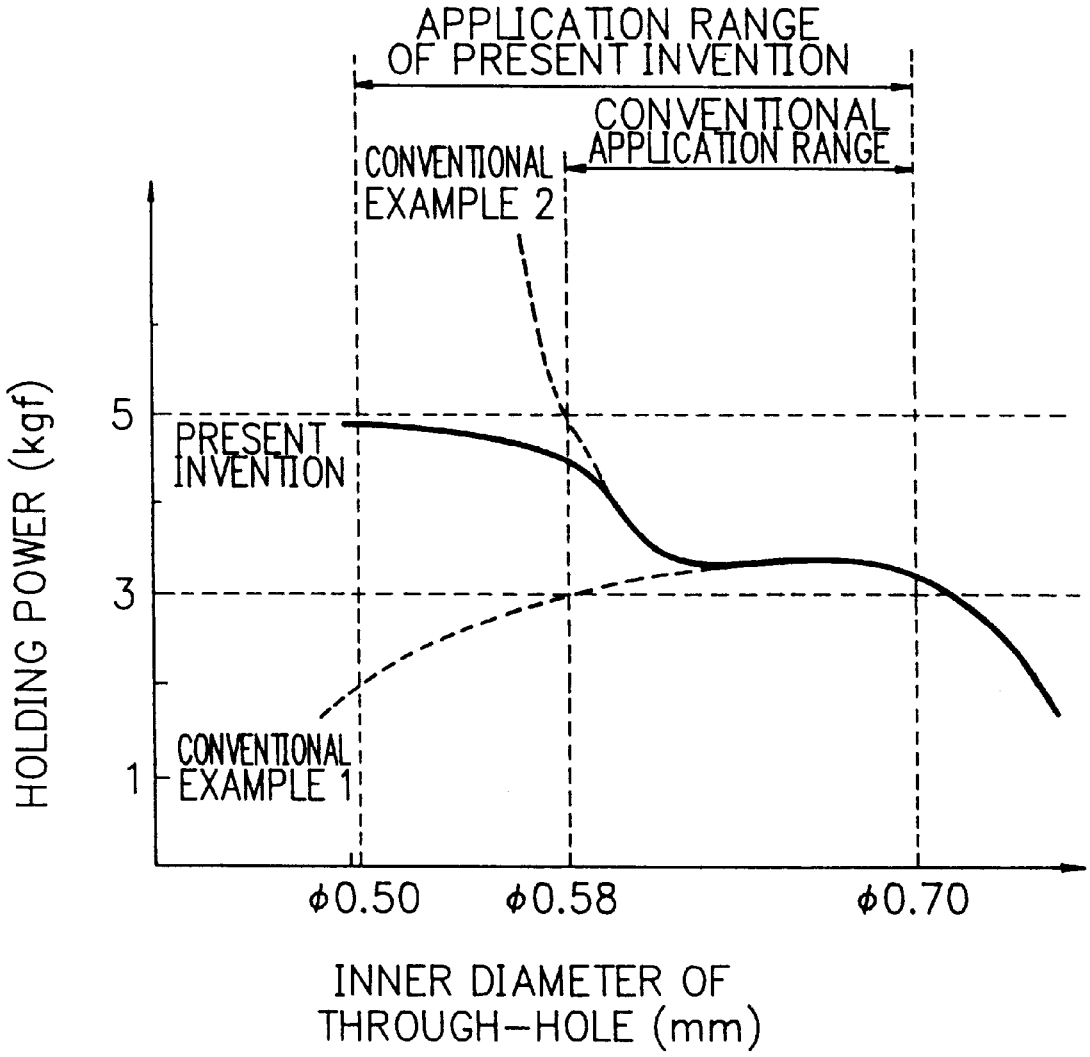
FIG. 13 is a graph showing a comparison of the characteristic of the press-in contact of the present invention with the conventional example.

FIGS. 9 to 13 are views for explaining one embodiment of the present invention. FIG. 9 is a perspective view for explaining structure of the press-in contact according to an embodiment of the present invention. FIG. 10A is a plan view of FIG. 9 for explaining structure of the press-in contact according to an embodiment of the present invention. FIG. 10B is a cross sectional view of the through-hole section of the board for explaining structure of the press-in contact according to an embodiment of the present invention. FIG. 11 is a cross sectional elevation view along line XI-XI' of FIG. 10A for explaining structure of the press fitting section of is the press-in contact according to an embodiment of the present invention. FIG. 12A is a cross sectional view showing a state where the press-in contact is forced into the through-hole with a relatively large inner diameter according to the embodiment of the present invention. FIG. 12B is a cross sectional view showing a state where the press-in contact is forced into the through-hole with a relatively small inner diameter according to the embodiment of the present invention. FIG. 13 is a graph comparing the characteristic of the press-in contact of the present invention with the conventional example.

Referring to FIGS. 9 to 13, the press-in contact of the present embodiment consists of a press fitting section 12 formed with larger diagonal dimensions than an inner diameter of a through-hole existing in a printed board, a post section 14 having rectangle cross-section formed with smaller diagonal dimensions than the inner diameter of the through-hole 16, and a transition section 13 in which diagonal dimensions from the post section 14 to the press fitting section 12 are enlarged gradually and formed smoothly.

In the present embodiment, thickness of the printed board is 1.6 mm, the inner diameter of the through-hole is 0.6 mm. Further, dimensions of the press fitting section 12 in a longitudinal direction is 1.6 mm, and blanking width ("W" of FIG. 11) is 0.65 mm. Dimensions of the transition section 13 in a longitudinal direction is 0.8 mm. Size of the post section 14 is that of a square 0.3 by 0.3 mm. The dimensions of these sections are not limited by these values, but they vary properly in accordance with the configuration of the through-hole 16.

Further, the cross sectional shape of the press fitting section 12 consists of an internal edge section and an external edge section. The internal edge section has an inverse trapezoid shape with concave shaped groove 11 of width 0.3 mm along a straight line in the groove base section and a depth of 0.2 mm. The external section consists of contact wing sections 22, 23 which protrude with length of 0.2 mm ("L" of FIG. 11) and which taper toward the open end, connecting sections 25, 26 which connect the contact wing sections, which are relatively thin and whose thickness is 0.1 mm, with respect to the base section 24, and a base section 24 having circular arc 27 with the radius of degree of 0.08 mm in order to contact with the through-hole 16.

Dimensions of respective sections are not limited by these values. Dimensions of respective sections are determined by the extent of change of an inner diameter of the through hole 16, and the required holding power between the press-in contact and the through-hole 16.

Furthermore, the base section of the contact wing sections 22, 23 are formed, respectively, by smooth circular arcs 28, 29, and 30, 31 with radii of 0.05 mm.

Here, the press-in contact of the present embodiment is made from spring metallic material such as phosphor bronze, beryllium copper, brass or the like. However, the present invention is not limited by these materials. Further, it is proper that metallic plating of nickel, solder, tin, gold or the like be placed on the surface thereof.

The press-in contact according to the present embodiment is forced into the through-hole whose inner diameter is on the order of 0.6±0.1 mm, which is disposed within a board whose thickness is on the order of 1.6 mm to 2.4 mm. The contact wings 22, 23 rotate toward the inside of the concave shaped groove 11 with fulcrums 34, 35 of the connecting sections 25, 26 as the center of rotation.

Here, when the press-in contact is forced into the through-hole 32 having a relatively large inner diameter on the order of 0.7 mm, a total of three points, respectively, of the upper circular arcs 28, 30, the contact wings 22, 23, and the circular arc 27 of the base section 24 are in contact with the through-hole 32 (referring to FIG. 12A). When the press-in contact is forced into the through-hole 33 with a relatively small inner diameter on the order of 0.5 mm, a total of five points of the upper circular arcs 28, 29, and lower circular arcs 30, 31 of the contact wings 22, 23, and the circular arc 27 of the base section 24 are contacted with the through-hole 33 (referring to FIG. 12B).

In the deformation process, the connecting sections 25, 26 become rotation centers of the contact wings 22, 23 because the thickness is as thin as 0.1 mm, thus stress converges positively thereto. Consequently, the connecting sections 25, 26 are easily collapsed, thus exhibiting compliant characteristics.

As a result, the press-in contact of the present embodiment can cope with the through hole whose inner diameter is from 0.7 mm to 0.5 mm flexibly, thus it is always capable of exhibiting stable electrical and mechanical characteristics.

The reason for this stability will be described while comparing with the conventional example.

Figure 1:
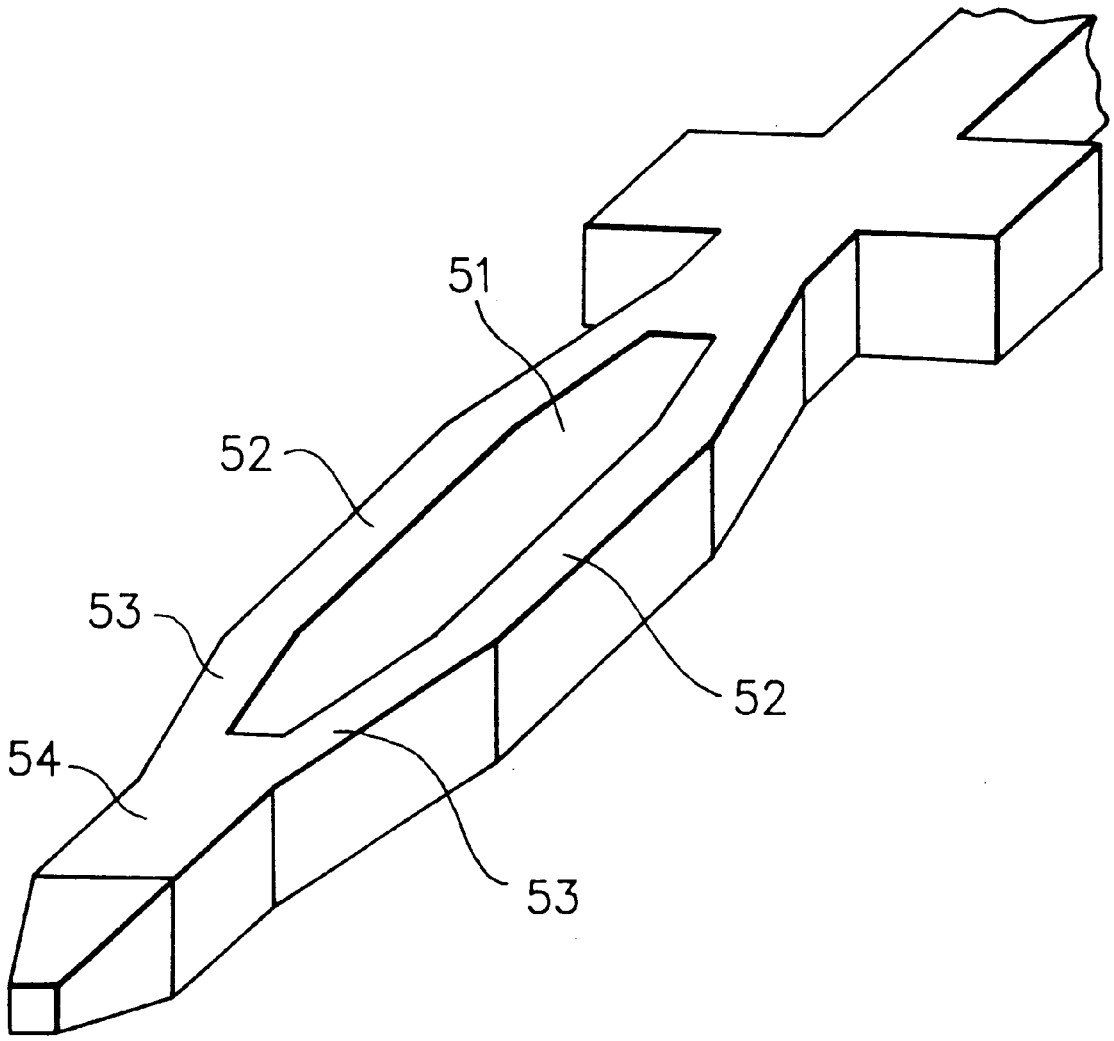
FIG. 1 PRIOR ART
FIG. 1 is a perspective view showing a first conventional example.
Figure 2A:
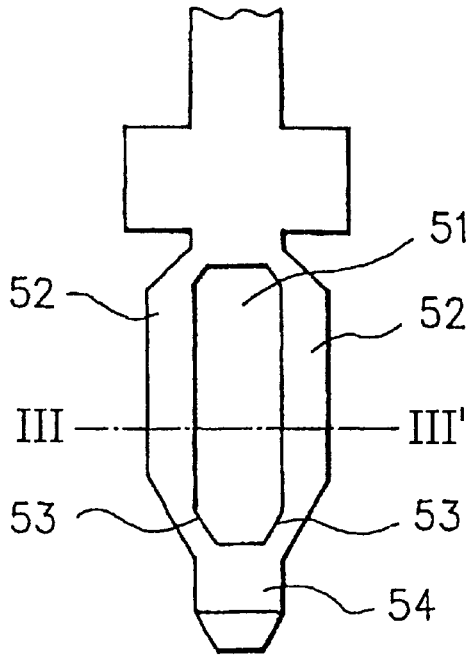
FIG. 2A PRIOR ART
FIG. 2A is a plan view showing the first conventional example of FIG. 1.
Figure 2B:
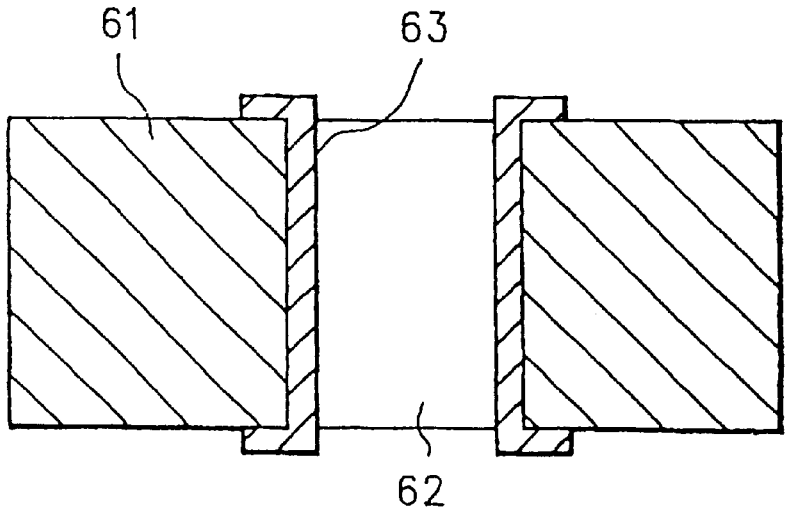
FIG. 2B PRIOR ART
FIG. 2B is a cross sectional view showing a through-hole section of a board of the first conventional example.
Figure 3:
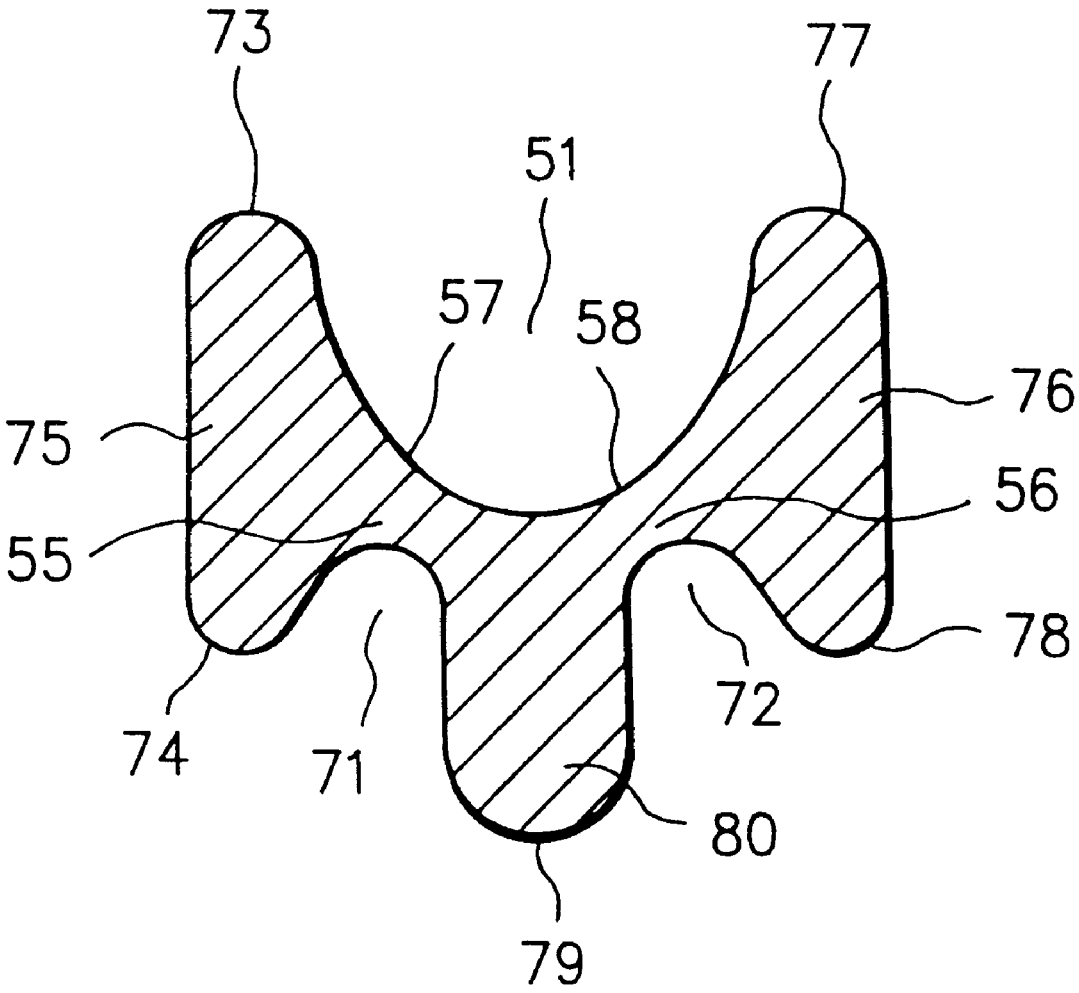
FIG. 3 PRIOR ART
FIG. 3 is a cross sectional elevation view along line III-III' of FIG. 2A of the first conventional example.
Figure 4:
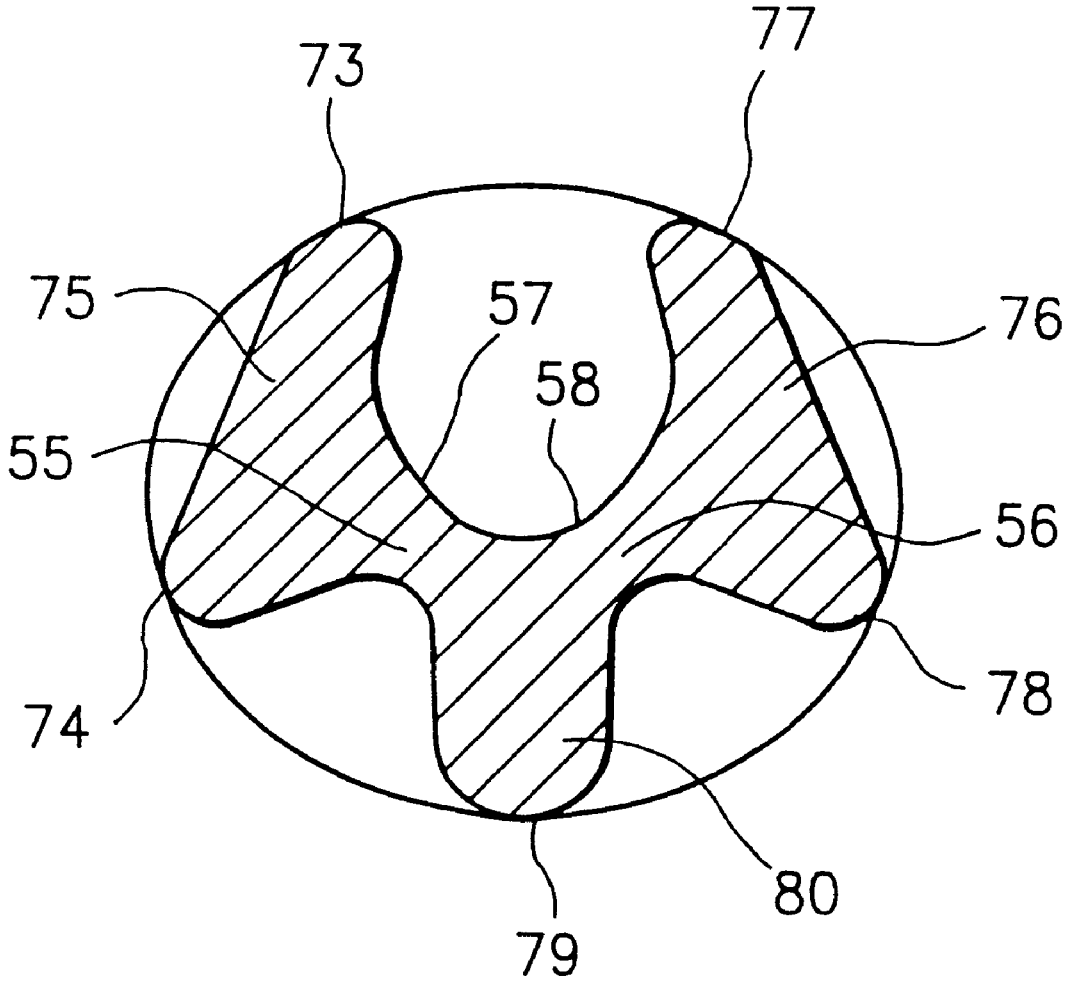
FIG. 4 PRIOR ART
FIG. 4 is a cross sectional view of the first conventional example showing a state where a press-in contact is forced into a through-hole.
Figure 5:
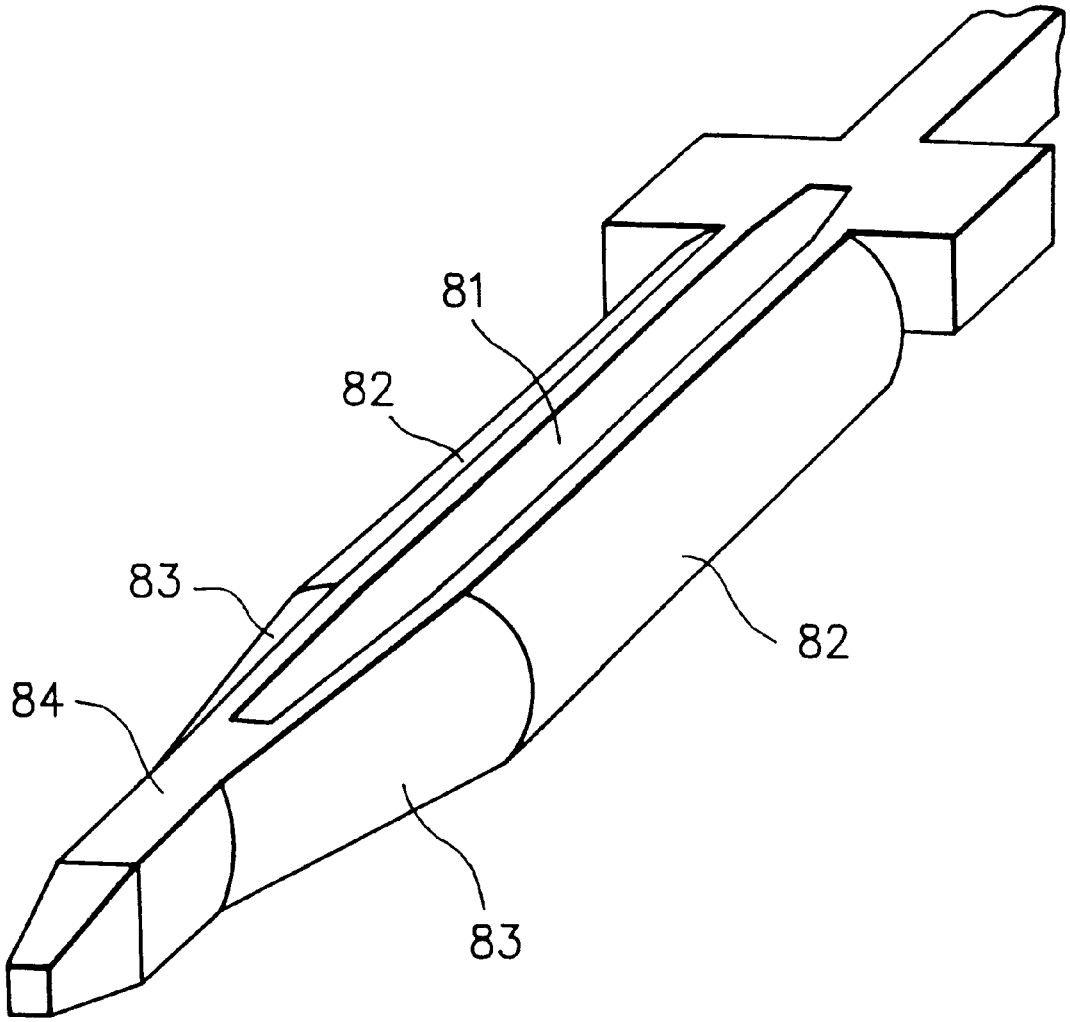
FIG. 5 PRIOR ART
FIG. 5 is a perspective view showing a second conventional example.
Figure 6A:
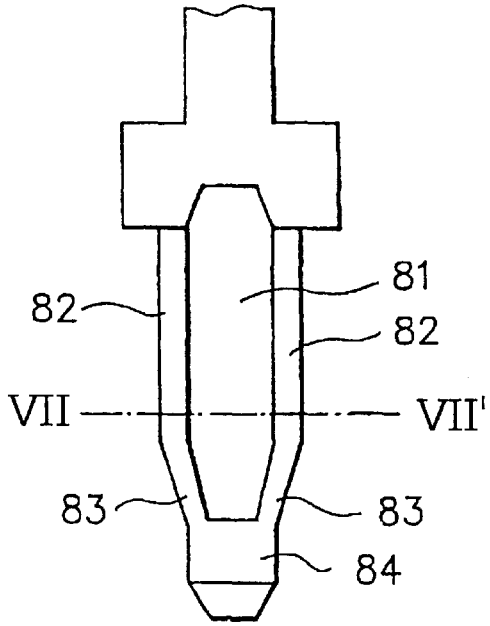
FIG. 6A PRIOR ART
FIG. 6A is a plan view showing the second conventional example of FIG. 5.
Figure 6B:
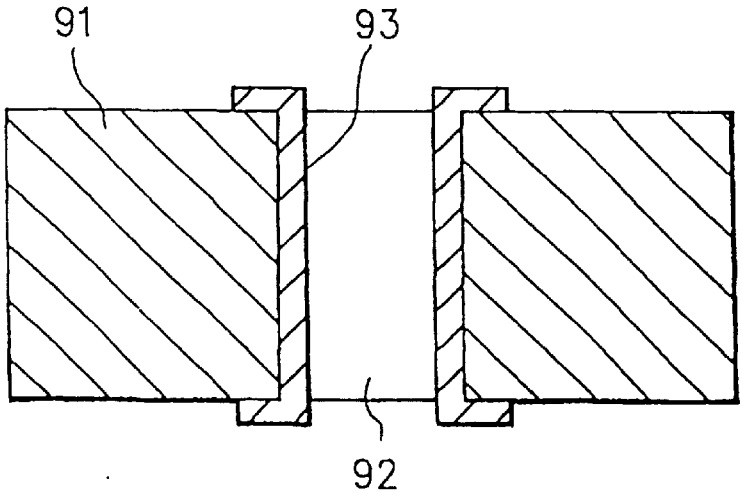
FIG. 6B PRIOR ART
FIG. 6B is a cross sectional view showing a through-hole section of a board of the second conventional example.

Namely, in the cases where thickness of the connecting sections 55, 56 are thin, as in the configuration shown in the first conventional example of FIG. 3, the contact wing sections 75, 76 exceed the plastic strain limit of the connecting sections 55, 56 when exceeding a certain amount of rotation, thus plastic failure occurs so that the contact wing sections 75, 76 suddenly collapse toward the inside of the concave shaped groove. The holding power between the press-in contact and the through-hole decreases remarkably. In FIG. 13, it is shown that the holding power decreases within the range that inner diameter of the through-hole is from 0.58 mm ϕ to 0.55 mm ϕ.

Figure 7:
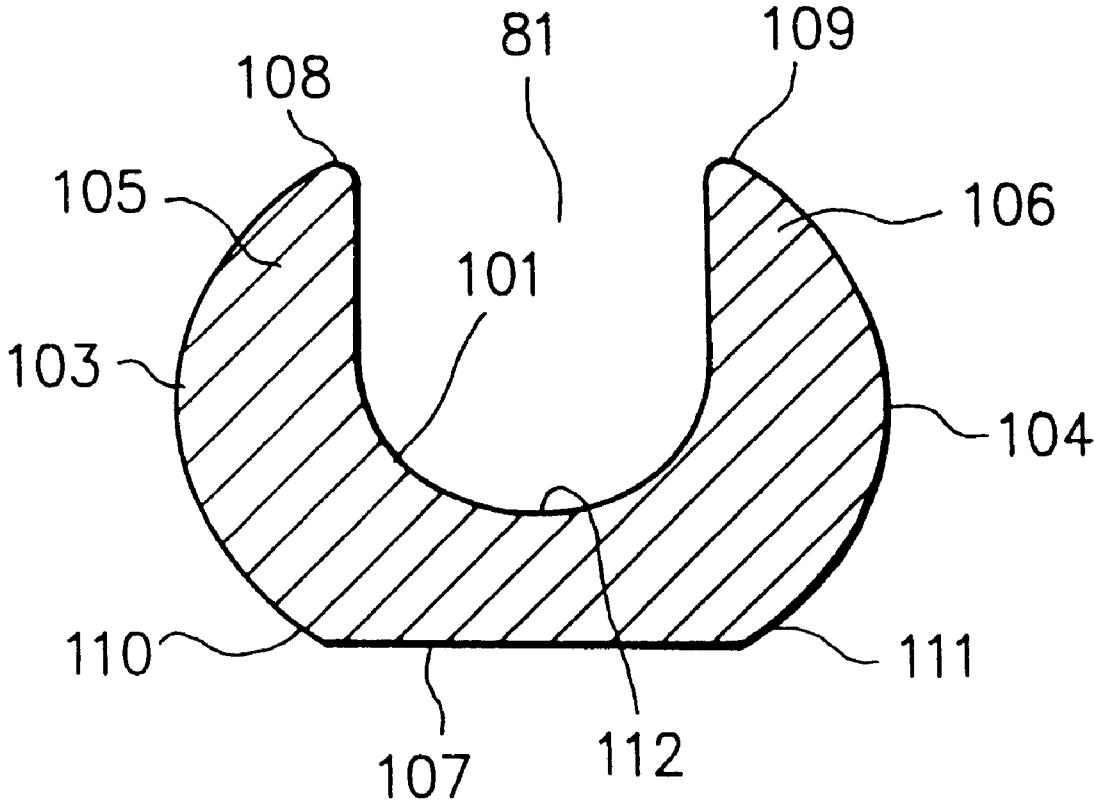
FIG. 7 PRIOR ART
FIG. 7 is a cross sectional elevation view along line VII-VII' of FIG. 6A of the second conventional example.
Figure 8:
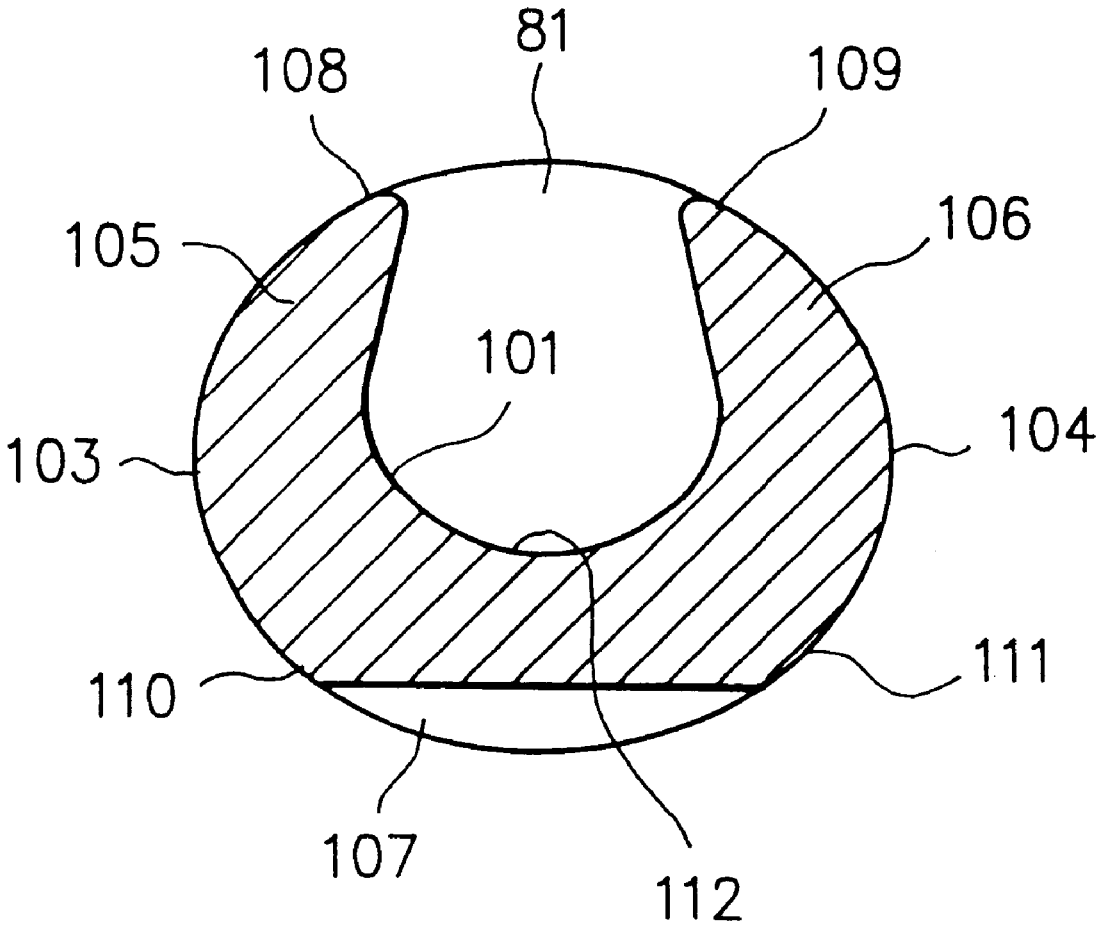
FIG. 8 PRIOR ART
FIG. 8 is a cross sectional view of the second conventional example showing a state where a press-in contact is forced into a through-hole.

Furthermore, in the cases where thickness of the base sections 110, 111 of the circular arcs 103, 104 are thick, as in the configuration shown in the second conventional example of FIG. 7, considerable force is necessary for collapsing the open end 108 toward the inside of the concave shaped groove 81. Failure of the inner wall of the through-hole, or buckling of the contact occurs before the open end 108 collapses toward the inside of the concave shaped groove 108, thus electrical and mechanical connection is incapable of being implemented. In FIG. 13, it is shown that the holding power increases suddenly in the vicinity of 0.58 mm ϕ of the inner diameter of the through hole.

On the other hand, in the present embodiment, the contact wings 22, 23 are set to easily collapse toward the inside of the concave shaped groove by making the thickness of the connecting sections 25, 26 shown in FIGS. 12A, 12B relatively thin. It causes the lower circular arcs 29, 31 of the contact wings 22, 23 to be in contact with the through-hole, before the connecting sections 25, 26 exceed the plastic strain limit for collapse. It is capable of being shifted to the new deformation position without failure of the connecting sections by changing the synthesized power vector which the contact wing sections receive from the through-hole.

In general, an appropriate range of the holding power between the through-hole and the press-in contact is thought to be from 3 kgf to 5 kgf. A necessary condition in order to bring such effect is that, when distance between both peripheral sides of the contact wing section is taken to be "W", the distance between the bottom of the base section and an end section of the open side of the contact wing section is taken to be "H", and the distance between an external edge of the connecting section and an end section of the open side of the contact wing section is taken to be "L" (referring to FIG. 11), it is represented by following relevant formula:

$$W^2-4\times H^2+4\times H\times L\approx 0$$

The relevant formula is derived from optimization of holding power by FEM (Finite Element Method) analysis.

Here, the horizontal axis of FIG. 13 represents the inner diameter of the through-hole, and the vertical axis represents holding power. Further, a solid line of FIG. 13 represents a calculated result for the press-in contact of the present embodiment. A fine dotted line represents a calculated result for the first conventional example. A thick dotted line represents a calculated result for the second conventional example.

When the shapes of the first conventional example and the second conventional example are applied to the present relevant formula, either case results in $W^2-4H^2+4HL>0.1$ $mm^2$.

While in the case of the present embodiment, the formula becomes $W^2-4H^2+4HL=0.018$ $mm^2$.

Thus, it is recognized that the calculated result is close to the condition of making the holding power between the through hole and the press-in contact to be 3 kgf to 5 kgf.

In FIG. 13, the holding power changes suddenly for the press-in contact of the conventional example when the inner diameter of the through-hole becomes less than 0.58 mm. In contrast, the press-in contact of the present embodiment indicates a stable characteristic of holding power in a wide range of inner diameter of the through-hole from 0.5 mm to 0.7 mm.

As stated above, according to the present invention, there is a first effect that it is capable of being exercised, that is, always stable electrical and mechanical characteristics, even with wide variation of the inner diameter of the through-hole.

The cross sectional shape of the press fitting section is made as an inverse trapezoid shape, including a straight line section at the internal edge section. The external edge section consists of two contact wing sections which protrude, and which taper as it goes toward the open end sides, connecting sections which connect the contact wing sections, and a base section in order to contact with the through-hole. When the inner diameter of the through-hole is relatively large, a total of three points of the respective upper circular arcs of the contact wing and the circular arc of the base section are in contact with the through-hole. When the inner diameter of the through-hole is relatively small, a total of five points of respective upper circular arcs and lower circular arcs of the contact wing section and the circular arc of the base section are in contact with the through-hole.

Furthermore, a center of deformation of the connecting section is isolated from an opening center of the through-hole by a required distance so that when the distance between both peripheral sides of the contact wing section is taken to be "W", a distance between bottom of base section and an end section of open side of the contact wing section is taken to be "H", and distance between external edge of the connecting section and end section of an open side of the contact wing section is taken to be "L", these satisfy the following relevant formula $W^2-4\times H^2+4\times H\times L\approx 0$, and the same effect is obtained.

A second effect is that it is capable of being made with improved productivity with a fewer number of manufacturing steps, and with long life of the die. The manufacturing process of the present invention has fewer process steps in comparison with the conventional manufacturing process. Since processing time is reduced, and the balance of the cross sectional shape is good, excessive stress is not applied to the convex shaped protrusion of the press, and thus life of the die increases, and it is capable of improved productivity.

While preferred embodiments of the invention have been described using specific terms, the description has been for illustrative purpose only, and it is to be understood that changes and variations may be made without departing from the spirit or scope of the following claims.

What is claimed is:

1. A press-in contact device for solderless mechanical and electrical connection of a contact pin connector into a printed circuit board hole, the press-in contact device comprising:

a post section having a first width;

a press fitting section having a second width (W) larger than said first width and being connected at a first end to said post section by a tapered transition section for easing insertion of the press-in contact device into the printed circuit board hole, said tapered transition section changing gradually in width from said first width to said second width, said press fitting section having a concave groove-shaped cross-section perpendicular to a longitudinal insertion direction, wherein said cross-section comprises a tapered base section on a bottom portion of said cross-section;

first and second contact wing sections located opposite said tapered base section on a top portion of said cross-section, said first and second contact wing sections being symmetrical about a centerline of said cross-section; and first and second connecting sections for flexibly connecting, respectively, said first and second contact wing sections to said tapered base section, each of said first and second contact wing sections being decreasingly tapered in thickness from an interface with said first and second connecting sections toward an end portion, and extending a height (H) above a bottom of said tapered base section and a length (L) above an end portion of a corresponding one of said first and second connecting sections, each of said first and second contact wing sections being deformable so as to mechanically and electrically contact an inside surface of the printed circuit board hole, and said first and second contact wing sections and said first and second connecting sections each being deformable in a direction toward the opening of the concave-shaped groove about fulcrums located intermediate to each of said first and second contact wing sections and said tapered base section.

2. The device of claim 1, wherein said concave-shaped groove has the shape of an inverted trapezoidal groove when said first and second contact wing sections are in a non-deformed state.

3. The device of claim 1, wherein said cross-section of said press fitting section is designed and adapted such that said second width (W), said height (H), and said length (L) have a dimensional relationship wherein a mechanical holding force of the press-in contact device when inserted into the printed circuit board hole is maintained between 3 and 5 kgf inclusively.

4. The device of claim 3, wherein the dimensional relationship is $W^2+4HL=4H^2$.

5. The device of claim 3, designed and adapted to accommodate a printed circuit board hole diameter of in the range of 0.5–0.7 mm, inclusively.

6. The device of claim 1, wherein said end portion of each of said first and second contact wing sections and an exterior corner of each of said first and second connecting sections have the shape of a smooth circular arc.

7. The device of claim 1, wherein the shape of a bottom of said tapered base section comprises smooth circular arcs.

8. A press-in contact device for insertion into a printed circuit board hole, wherein the device cross-section perpendicular to a longitudinal insertion direction comprises:

a tapered base section on a bottom portion of the device cross-section;

first and second contact wing sections symmetrical about a centerline of the device cross-section and located opposite said tapered base section on a top portion of the device cross-section, first and second connecting sections for flexibly connecting, respectively, said first and second contact wing sections to said tapered base section, said first and second contact wing sections each having a tapered end portion which gradually increases in thickness to a first thickness at an interface between each contact wing section and the corresponding connecting section, each of said first and second contact wing sections being deformable in directions about respective centers of rotation toward a concave-shaped groove opening so as to mechanically and electrically contact an inside surface of the printed circuit board hole when inserted into the hole, and said respective centers of rotation each being located a required offset distance from a centerline of the printed circuit board hole.

9. The press-in contact device of claim 8, wherein said required offset distance of said respective centers of rotation is one-fourth the inner diameter of the printed circuit board hole.

10. The press-in contact device of claim 8, wherein each of said respective centers of rotation is located at a position intermediate to a corresponding one of said tapered end portions and said tapered base section, and wherein the distance between said intermediate position and said tapered end portion is different than the distance between said intermediate position and a corresponding exterior corner of one of said first and second connecting sections.

11. A method of manufacturing a press-in contact device for solderless mechanical and electrical connection of a contact pin connector into a printed circuit board hole, the device comprising a post section having a first width, a press fitting section having a second width (W) larger than the first width and being connected at a first end to the first post section by a tapered transition section for easing insertion of the press-in contact device into the printed circuit board hole, the tapered transition section changing gradually in width from the first width to the second width, and the press fitting section having a concave groove-shaped cross-section in the shape of an inverted trapezoid perpendicular to a longitudinal insertion direction, wherein the cross-section of the press-in contact comprises a tapered base section on a bottom portion of the cross-section, first and second contact wing sections located opposite the tapered base section on a top portion of the cross-section and being symmetrical about a centerline of the device cross-section, and first and second connecting sections for flexibly connecting, respectively, the first and second contact wing sections to the tapered base section, each of the first and second contact wing sections being tapered in thickness from the first and second connecting sections toward an end portion, wherein each of the first and second contact wing sections and the first and second connecting sections are deformable in a direction toward the opening of the concave-shaped groove about fulcrums located intermediate to each of the first and second contact wing sections and the tapered base section so as to allow the first and second contact wing sections to mechanically and electrically contact an inside surface of the printed circuit board hole when the press-in contact device is inserted into the hole, and wherein the dimensional relationship between the second width (W), the height (H), and the length (L) is $W^2+4HL=4H^2$ so that a mechanical holding force of the press-in contact device, when inserted into the printed circuit board hole, is maintained between 3 and 5 kgf inclusively, the method comprising the steps of:

stamping a piece of plug-in contact material to form the post section, the transition section, and a blank of the press-fitting section;

forming the concave-shaped groove, the first and second contact wing sections, and the first and second connecting sections by using a punch having an inverse trapezoidal shape;

forming the tapered base section by using a die; and shaping the first and second contact wing sections, the first and second connecting sections, and the tapered base section by using a face press punch having smooth circular arcs.

12. The method of claim 11, wherein the steps of forming the concave-shaped groove, forming the tapered base section, and shaping the first and second contact wing sections steps are performed simultaneously.

13. The method of claim 11, wherein the steps of forming the concave-shaped groove, forming the tapered base section, and shaping the first and second contact wing sections steps are performed by a progressive die.

* * * * *